US006851233B2

(12) United States Patent
Morgenstern

(10) Patent No.: US 6,851,233 B2
(45) Date of Patent: Feb. 8, 2005

(54) CAST LOG STRUCTURE

(76) Inventor: Richard Morgenstern, 15985 Millcreek Rd., Frenchtown, MT (US) 59834

( * ) Notice: Subject to any disclaimer, the term of this patent is extended or adjusted under 35 U.S.C. 154(b) by 113 days.

(21) Appl. No.: 09/953,678

(22) Filed: Sep. 15, 2001

(65) Prior Publication Data

US 2003/0054189 A1 Mar. 20, 2003

(51) Int. Cl.[7] ..... E04B 1/62

(52) U.S. Cl. ..... 52/233; 52/405.1; 52/407.5; 52/417

(58) Field of Search ..... 52/233, 405.1, 52/426, 407.5, 604, 309.17, 378, 379, 562, 565, 417, 428

(56) References Cited

U.S. PATENT DOCUMENTS 1,925,103 A * 9/1933 Loftus et al. ..... 52/314
3,902,296 A * 9/1975 Thomas ..... 52/747
4,344,263 A * 8/1982 Farmont ..... 52/233
4,356,676 A * 11/1982 Hauptman ..... 428/317.3
4,936,062 A * 6/1990 Golston et al. ..... 52/127.1
5,163,259 A * 11/1992 Hunsaker et al. ..... 52/233
5,349,798 A * 9/1994 Gross ..... 52/309.12
5,706,620 A * 1/1998 De Zen ..... 52/220.2
6,050,765 A * 4/2000 McGovern et al. ..... 411/387.2
6,266,934 B1 * 7/2001 Houseal ..... 52/233
6,272,802 B1 * 8/2001 Berberich ..... 52/233
6,378,261 B1 * 4/2002 Agsten ..... 52/426

* cited by examiner

*Primary Examiner*—Carl D. Friedman
*Assistant Examiner*—Basil Katcheves
(74) *Attorney, Agent, or Firm*—Saliwanchik, Lloyd & Saliwanchik

(57) ABSTRACT

A structural system includes a plurality of structural elements. Each of the elements includes an interior layer, an exterior layer, and an insulating layer between the interior layer and the exterior layer. The structural elements are stacked adjacent to one another to form a wall. A respective cushion is placed between adjacent structural elements. The cushions create airspaces such that there is no direct surface contact between adjacent structural elements. The exterior layers of the structural elements can be fabricated from cast concrete material, and can be provided with simulative exterior surfaces, for example, with exterior surfaces simulating the appearance of structural logs.

18 Claims, 3 Drawing Sheets

CAST LOG STRUCTURE

FIELD OF THE INVENTION

The invention relates generally to structures composed of log elements. Specifically, the invention relates to structures composed of cast log elements that provide enhanced appearance, insulative properties, and ease of assembly.

BACKGROUND OF THE INVENTION

Log structures have been instrumental in the history of many cultures. As a result, such structures have become symbolic in many places, going beyond mere shelter and into the realm of cultural icon. Log structures, specifically log homes, have therefore become desirable due not only to their natural beauty, but because of their historical and cultural feel as well.

Unfortunately, log construction is not particularly well adapted to modern building standards. Log structures are often dark and closed-in by modern standards, and have a tendency to "settle" as the logs age. Furthermore, log construction fails to provide the insulation values available in standard modern construction methods.

It can thus be expected that the improvement of log structures, and the emulation of certain aspects of log structures using alternative materials, has been the subject of inventive activity. For example, U.S. Pat. No. 4,503,648 to Mahaffey is directed to a lightweight composite building module capable of being readily attached to other correspondingly shaped modules for providing a wall of a building. The module includes a pair of spaced elongated wooden side boards joined by a wooden top board. The side boards have right angle cutouts removed from the inside corners thereof producing upper and lower horizontally extending ledges. Polyurethane foam is provided in the cavity defined by the side boards and top boards with said foam extending below the lower horizontally extending ledges. Elongated wooden bolts extend between the top boards of adjacent stacked modules drawing said modules tightly together under compression so that the top board of the next lower module compresses the foam extending below the lower horizontally extending ledges of the module carried directly therebelow producing a rigid sealed joint therebetween.

U.S. Pat. No. 5,163,259 to Hunsaker et al. discusses a modular building component made of solid wood, capable of being fitted onto other correspondingly shaped modules to provide a wall of a building. The module includes a core made of horizontally laminated wood with a lengthwise groove cut along the top and vertically at one end for utility purposes, to which side boards are attached in a manner which allows each module to lock into adjoining modules both vertically and horizontally. The upper edges of side boards are attached a short space from the top of the core, the lower edges extending past the bottom of the core, creating both a male and female fitting for adjoining modules. In the same manner side boards are offset a short space from one end of the core and extend past the core at the opposite end to allow the ends of modules to lock as well. The side boards are attached at the factory with adhesive bonding material and secured with fasteners. To form walls, the modules are stacked a row at a time and locked together using adhesive and metal fasteners for which holes have been pre-drilled in the laminated cores.

In another example, U.S. Pat. No. 4,433,519 to Jenkins shows a hollow cylindrical prefabricated modular construction element is formed by generally circular supports and a sheath. These hollow cylinders are connected, using simple carpentry tools, at a building site to create walls, having a simulated log appearance.

U.S. Pat. No. 4,288,954 to O'Donnell is directed to simulated log siding in which wire metal lath is shaped to the generally semicircular configuration associated with a length of log used in a log wall structure. Several layers of cement-plaster are applied Lo the metal lath to waterproof it, and to lend texture and color to it. The effect of the layered and colored cement-plaster is to render the appearance of an actual log with its bark in place. A simulated log wall siding is made up of multiple lengths of such cement-plaster coated, simulated logs.

U.S Pat. No. 3,552,079 to Mortensen discusses a building element including a panel-shaped insulating material extending between two timber half-beams, the whole element being formed as a beam with one or more tongues and grooves and with the insulating material extending in the full height of the beam from the bottom of a groove or surface between two tongues to the opposite edge of the beam, and an angle joint between two walls made of building elements having notches round a neck section for mutual connection of the elements.

While each of these patents show some advantages, it can be seen from the foregoing that the need exists for a simple, inexpensive construction system that provides the aesthetic advantages of log structures without sacrificing the functional advantages of modern building practices and materials.

SUMMARY OF THE INVENTION

A structural system includes a plurality of structural elements. Each of the elements includes an interior layer, an exterior layer, and an insulating layer between the interior layer and the exterior layer. The structural elements are stacked adjacent to one another to form a wall. A respective cushion is placed between adjacent structural elements. The cushions create airspaces such that there is no direct surface contact between adjacent structural elements. The exterior layers of the structural elements can be fabricated from cast concrete material, and can be provided with simulative exterior surfaces, for example, with exterior surfaces simulating the appearance of structural logs.

DETAILED DESCRIPTION OF THE INVENTION

Figure 1:
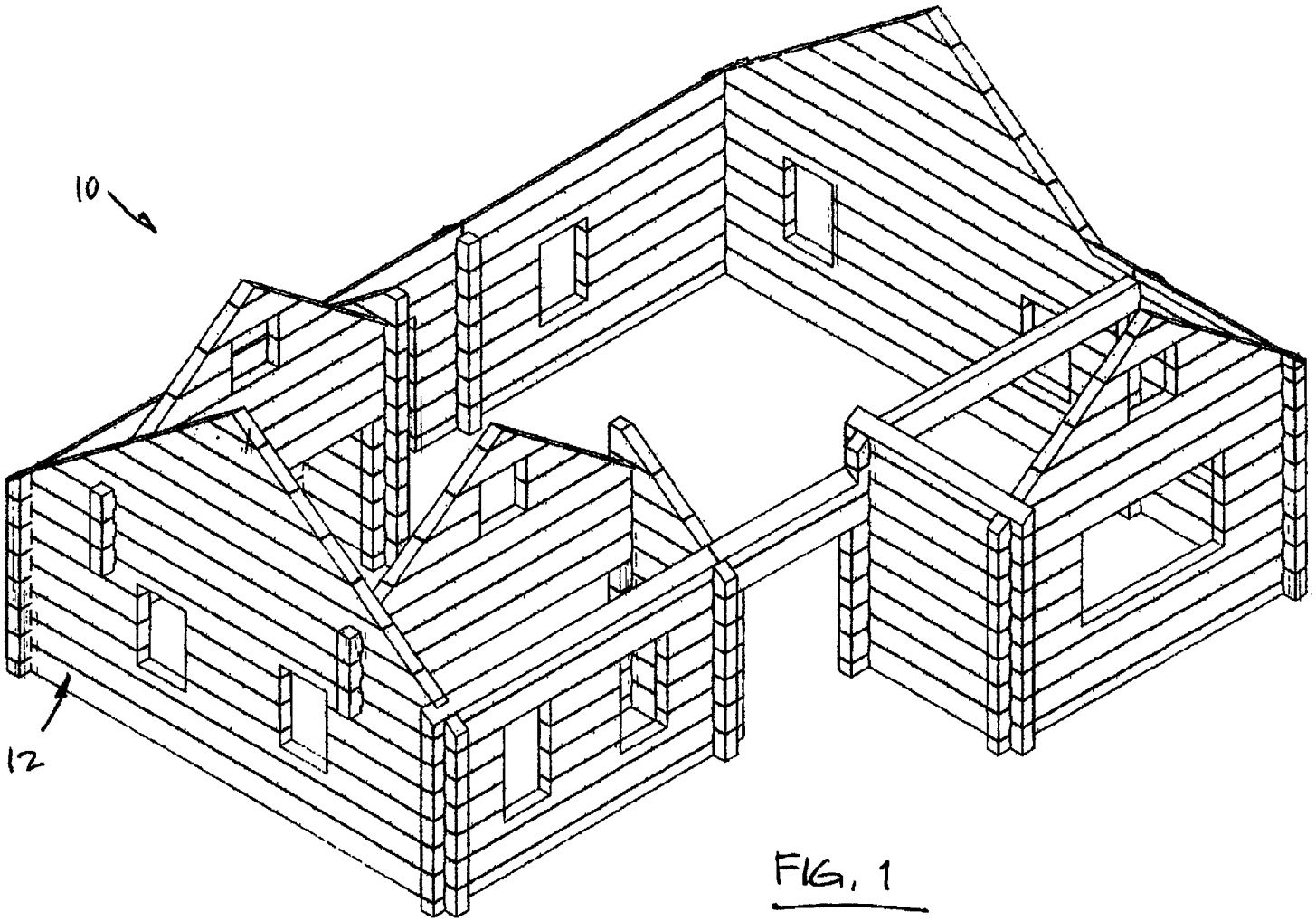
FIG. 1 is a schematic perspective view of a structure in accordance with the principles of the present invention.

A structure 10 in accordance with the principles of the present invention is shown in FIG. 1. The structure 10 includes a plurality of walls 12 having the external appearance of a traditional wooden log home.

Figure 2:
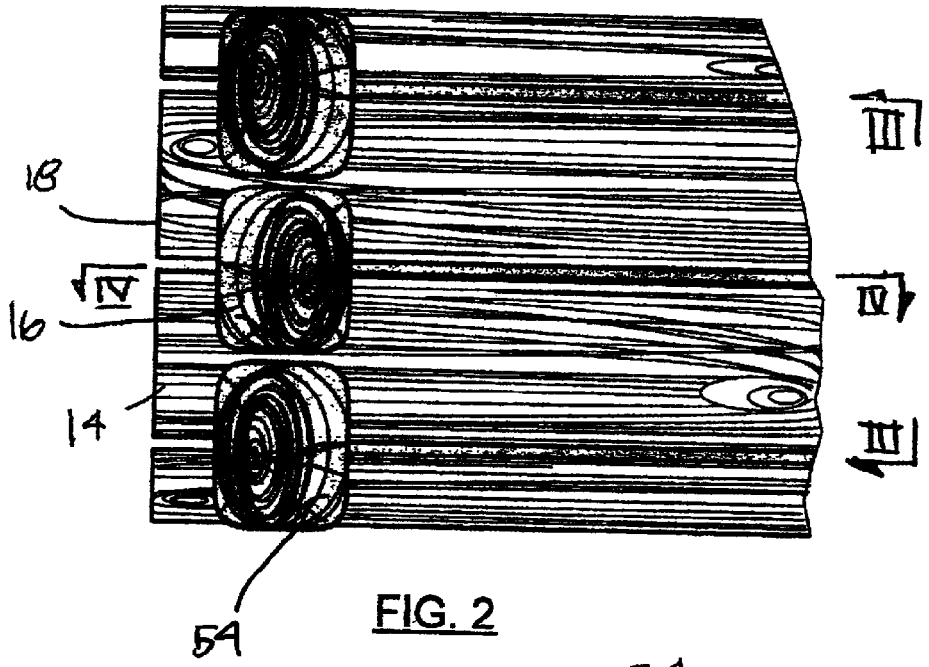
FIG. 2 is a detailed elevational view of the structure shown in FIG. 1.

Each wall 12 of the structure 10 is made up of a plurality of structural elements, joined together as are structural elements 14, 16, and 18 shown in FIG. 2. The structural elements 14, 16, and 18 are assembled in such a way as to simulate the appearance of structural logs, with their visible faces and ends molded to resemble log surfaces. The structural elements provide this appearance while providing insulative and structural properties unattainable with traditional log construction. This is accomplished by the construction details of each structural element.

Figure 3:
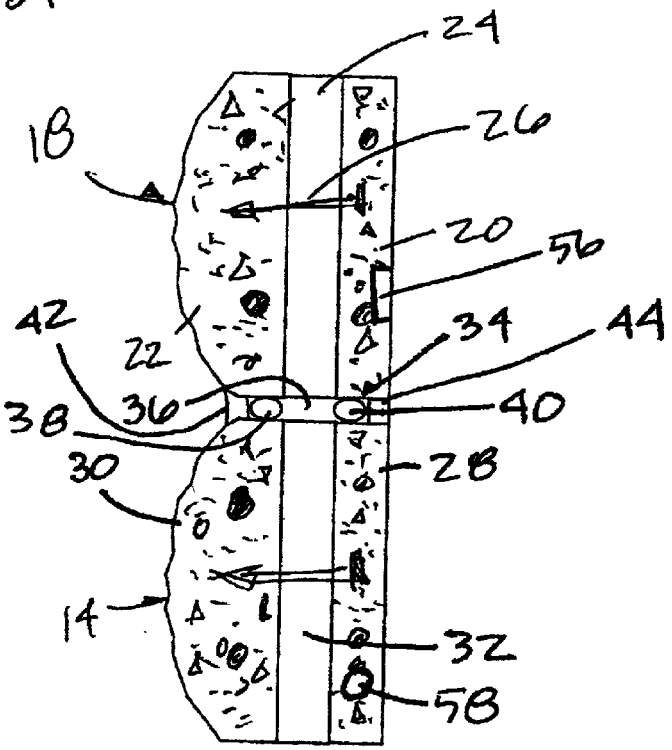
FIG. 3 is a sectional view taken generally along lines III—III in FIG. 2.

As seen in FIG. 3, the structural element 18 includes an interior layer 20, an exterior layer 22, and an insulating layer 24 between the interior layer 20 and the exterior layer 22. The interior layer 20 and the exterior layer 22 can be fabricated by being cast from a cementitious material, such as concrete, and can be held together in a conventional manner, such as by connector rods 26. One example of a suitable connection arrangement is shown in U.S. Pat. No. 5,519,973 to Keith, the specification of which is incorporated by reference herein. The insulating layer 24 can be fabricated from any known, suitable insulation material used in concrete paneling systems, such as Dow Chemical's Thermomass System, Owens-Corning's Pink Core Panel System, FabCor's Panel tie system, etc.

The structural element 14 includes an interior layer 28, an exterior layer 30, and an insulating layer 32 between the interior layer 28 and the exterior layer 30. The interior layer 28 and the exterior layer 30 can be fabricated by being cast from a cementitious material, such as concrete, and can be held together in a conventional manner, such as by connector rods as described previously. The insulating layer 32 can be fabricated from any known, suitable insulation material as previously mentioned.

A cushion 34 is located between the first structural elements 14 and the second structural element 18. The cushion 34 creates an airspace 36 such that there is no direct surface contact between the adjacent structural elements 14, 18. The cushion 34 includes first and second elongated, resilient cushion elements 38, 40 extending along a length of the structural elements 14, 18. The first cushion element 38 is secured between the exterior layer 30 of the first structural element 14 and the exterior layer 22 of the second structural element 18. The second cushion element 40 is secured between the interior layer 28 of the first structural element 14 and the interior layer 20 of the second structural element 18.

Flexible synthetic chinking material 42 can be applied between the exterior layer 30 of the first structural element 14 and the exterior layer 22 of the second structural element 18 at a position outside of the first cushion element 38. Fill material 44, which can be identical to the chinking material 42, can be applied between the interior layer 28 of the first structural element 14 and the interior layer 20 of the second structural element 18.

Figure 4:
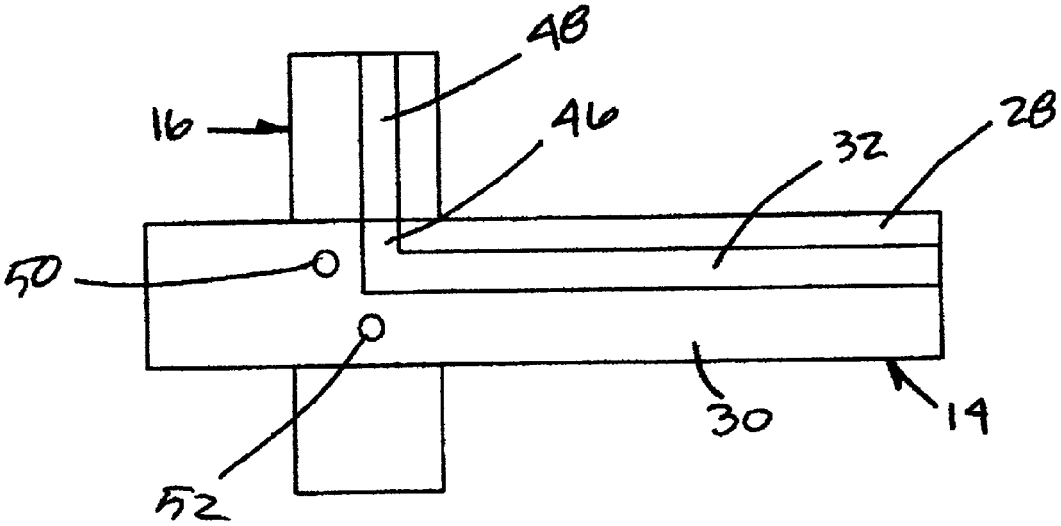
FIG. 4 is a sectional view taken generally along lines IV—IV in FIG. 2.

As seen in FIG. 4, the insulating layers of the structural elements can be provided with angled portions to provide a substantially continuous layer of insulation between the interior and the exterior of the structure. Here, the insulating layer 32 of the structural element 14 is provided with an angled portion 46, which aligns with an insulating layer 48 of the structural element 16.

Figure 5:
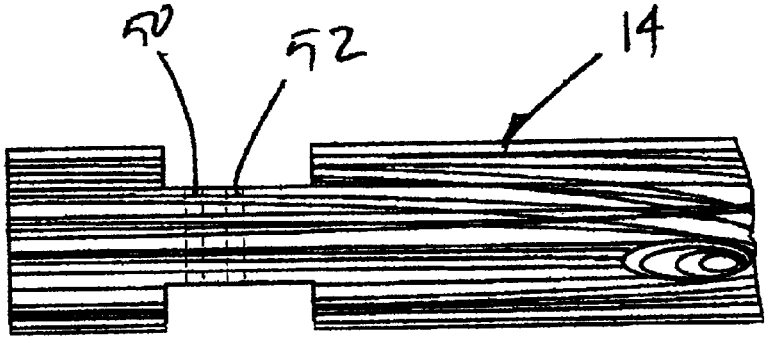
FIG. 5 is a detailed elevational view of a structural element in accordance with the principles of the present invention.

The structural elements are secured together at bearing points, here illustrated as grout sleeves 50, 52 extending through the corner joints of the structural elements (FIGS. 4 and 5). The grout sleeves 50, 52 extend vertically through the structural elements. Vertical reinforcing steel bars are placed into the aligned grout sleeves, after which high-strength grout is poured into the sleeves to encase the rebars and permanently tie the structural elements together into walls.

The interior and exterior layers of the structural elements can be fabricated from cast concrete material, and can be provided with simulative exposed surfaces. In the illustrated embodiment, the exterior surfaces of the structural elements simulate the appearance of hand-hewn structural logs, including end surfaces 54 (FIG. 1). It is also anticipated that the exterior surfaces could be fabricated to simulate round logs, or any other desired horizontal structural element, and that the simulated log surfaces can be textured and stained to simulate stripped logs or logs with the bark left on. Similarly, the interior surfaces of the structural elements can be fabricated to simulate log surfaces, wood paneling, stone, sheetrock, or any desired texture, and can be stained or painted to any suitable interior finish. The structural elements can be fabricated using rubber molds made from actual timbers, logs, paneling, stones, etc. using rubber molds in a generally known manner. Companies from which such molds are available in other configurations include Symons, Burke, Scofield, and Scott. Electrical and heating conduits 56, 58 can be cast in the wall during fabrication to avoid surface mounting.

Walls assembled in accordance with the principles of the present invention are nearly 100% insulated. It is contemplated that their energy efficiency will far surpass that of "real" log structures and other conventional building systems, due to their provision of an interior heat sink. The structural elements can be assembled on site using standard construction equipment in a manner similar to that used in traditional log construction.

Although the present invention has been described with reference to specific embodiments, those of skill in the art will recognize that changes may be made thereto without departing from the scope and spirit of the invention as defined by the appended claims.

What is claimed is:

1. A structural system comprising the following:

a first pre-cast structural element including an interior layer cast from a cementitious material, an exterior layer cast from a cementitious material, and an insulating layer between the interior layer and the exterior layer, the insulating layer substantially completely isolating the interior layer from the exterior layer;

a second pre-cast structural element including an interior layer cast from a cementitious material, an exterior layer cast from a cementitious material, and an insulating layer between the interior layer and the exterior layer, the insulating layer substantially completely isolating the interior layer from the exterior layer; and a cushion between the first and second structural elements creating airspace such that there is no contact between the first and second structural elements; and a grout sleeve to secure the first structural element to the second structural element creating a bearing point between the first structural element and the second structural element.

2. A structural system in accordance with claim 1, wherein the exterior layer of the first element and the exterior layer of the second structural element are provided with simulative exterior surfaces.

3. A structural system in accordance with claim 2, wherein the exterior layer of the first structural element and the exterior layer of the second structural element are provided with exterior surfaces simulating the appearance of structural logs.

4. A structural system in accordance with claim 1, further comprising at least one connector rod in each of the first and second structural elements, the connector rods securing the interior layer to the exterior layer.

5. A structural system in accordance with claim 1, wherein the cushion comprises at least one elongated resilient cushion member extending along a length of the first and second structural elements.

6. A structural system in accordance with claim 5, wherein the cushion comprises first and second cushion elements.

7. A structural system in accordance with claim 6, wherein the first cushion element is secured between the exterior layer of the first structural element and the exterior layer of the second structural element, and the second cushion element is secured between the interior layer of the first structural element and the interior layer of the second structural element.

8. A structural system in accordance with claim 7, wherein the insulating layers of the first and second structural elements are fabricated.

9. A structural system in accordance with claim 1, further comprising a chinking material between the exterior layer of the first structural element and the exterior layer of the second structural element at a position outside of the first cushion element.

10. A structural system in accordance with claim 1, wherein the insulating layers of the first and second structural elements are fabricated from an expanded plastic material.

11. A structural system comprising the following;

a plurality of pre-cast structural elements, each of the elements including an interior layer cast from a cementitious material, an exterior layer cast from a cementitious material, and an insulating layer between the interior layer and the exterior layer, the insulating layer substantially completely isolating the interior layer from the exterior layer, the structural elements being stacked adjacent to one another to form a wall; and a respective cushion between adjacent structural elements, the cushions creating airspace such that there is no direct surface contact between adjacent structural elements; and a grout sleeve to secure the first structural element to the second structural element creating a bearing point between the first structural element and the second structural element.

12. A structural system in accordance with claim 11, wherein the exterior layers of the structural elements are provided with simulative exterior surfaces.

13. A structural system in accordance with claim 12, wherein the exterior layer of the structural elements are provided with exterior surfaces simulating the appearance of structural logs.

14. A structural system in accordance with claim 13, wherein the interior layers of the structural elements are provided with planar interior wall surfaces.

15. A structural system in accordance with claim 14, wherein each respective cushion comprises first and second cushion elements.

16. A structural system in accordance with claim 15, wherein the first cushion element is secured between the exterior layers of adjacent structural elements, and the second cushion element is secured between the interior layers of adjacent structural elements.

17. A method of assembling a structural system, the method comprising the following steps:

providing a plurality of pre-cast structural elements, each of the elements including an interior layer cast from a cementitious material, an exterior layer cast from a cementitious material, and an insulating layer between the interior layer and the exterior layer, the insulating layer substantially completely isolating the interior layer from the exterior layer;

placing a respective cushion between adjacent structural element, the cushion creating airspace such that there is no direct surface contact between adjacent structural elements;

stacking the structural elements adjacent to one another to form a wall; and pouring a grout sleeve to secure the first structural element to the second structural element creating a bearing point between the first structural element and the second structural element.

18. A method in accordance with claim 17, wherein the step of providing a plurality of structural elements comprises casting the exterior layers of the structural elements from cast concrete material to resemble structural log elements.

* * * * *

UNITED STATES PATENT AND TRADEMARK OFFICE

CERTIFICATE OF CORRECTION

PATENT NO. : 6,851,233 B2
DATED : February 8, 2005
INVENTOR(S) : Richard Morgenstern It is certified that error appears in the above-identified patent and that said Letters Patent is hereby corrected as shown below:

Column 2,
Line 8, "Lo" should read -- to --

Signed and Sealed this

Seventeenth Day of May, 2005

JON W. DUDAS
*Director of the United States Patent and Trademark Office*